United States Patent [19]

Spacil et al.

[11] Patent Number: 5,032,762

[45] Date of Patent: Jul. 16, 1991

[54] PROTECTIVE BERYLLIUM OXIDE COATING FOR HIGH-INTENSITY DISCHARGE LAMPS

[75] Inventors: Henry S. Spacil; Ronald H. Wilson, both of Schenectady, N.Y.

[73] Assignee: General Electric Company, Schenectady, N.Y.

[21] Appl. No.: 553,038

[22] Filed: Jul. 16, 1990

[51] Int. Cl.[5] ..... H01J 61/18; H01J 61/35; H01J 9/20

[52] U.S. Cl. ..... 313/635; 313/638; 427/107; 445/13

[58] Field of Search ..... 313/635, 638, 639; 427/107; 445/13, 38, 58

[56] References Cited

U.S. PATENT DOCUMENTS

| | | | |
|---|---|---|---|
| 3,350,598 | 10/1967 | Corbin et al. | 313/635 |
| 3,377,498 | 4/1968 | Koury et al. | 313/635 |
| 3,900,754 | 8/1975 | Mason et al. | 313/635 |
| 4,339,686 | 7/1982 | Potter | 313/635 |
| 4,647,821 | 3/1987 | Lapatovich et al. | 313/638 X |
| 4,810,938 | 3/1989 | Johnson et al. | 315/248 |

FOREIGN PATENT DOCUMENTS

| | | | |
|---|---|---|---|
| 2066561 | 7/1981 | United Kingdom | 445/13 |

OTHER PUBLICATIONS

Waymouth, J. F., "Electric Discharge Lamps", MIT Press, 1971, pp. 266–277.

*Primary Examiner*—Palmer C. DeMeo

*Attorney, Agent, or Firm*—Jill M. Breedlove; James C. Davis, Jr.; Marvin Snyder

[57] ABSTRACT

A protective beryllium oxide coating of suitable thickness is applied to the inner surface of the arc tube of a high-intensity, metal halide discharge lamp in order to avoid a substantial loss of the metallic portion of the metal halide fill and hence a substantial buildup of free halogen, thereby extending the useful life of the lamp. A preferred lamp structure includes a fused silica arc tube. The beryllium oxide coating is preferably applied to the arc tube by evaporating beryllium in the arc tube under non-oxidizing conditions, and then heating in an oxidizing atmosphere.

10 Claims, 1 Drawing Sheet

PROTECTIVE BERYLLIUM OXIDE COATING FOR HIGH-INTENSITY DISCHARGE LAMPS

RELATED APPLICATIONS

This application is related to commonly assigned U.S. patent application Ser. No. 553,304 of H. L. Witting et al., and to commonly assigned U.S. patent application Ser. No. 553,303 of V. D. Roberts, D. A. Doughty and J. L. Myers, both applications filed concurrently herewith and incorporated by reference herein.

FIELD OF THE INVENTION

The present invention relates generally to high-intensity, metal halide discharge lamps. More particularly, the present invention relates to a protective coating for a high-intensity, metal halide discharge lamp for extending the useful life of the lamp.

BACKGROUND OF THE INVENTION

In operation of a high-intensity metal halide discharge lamp, visible radiation is emitted by the metallic portion of the metal halide fill at relatively high pressure upon excitation typically caused by passage of current therethrough. One class of high-intensity, metal halide lamps comprises electrodeless lamps which generate an arc discharge by establishing a solenoidal electric field in the high-pressure gaseous lamp fill comprising the combination of one or more metal halides and an inert buffer gas. In particular, the lamp fill, or discharge plasma, is excited by radio frequency (RF) current in an excitation coil surrounding an arc tube which contains the fill. The arc tube and excitation coil assembly acts essentially as a transformer which couples RF energy to the plasma. That is, the excitation coil acts as a primary coil, and the plasma functions as a single-turn secondary. RF current in the excitation coil produces a time-varying magnetic field, in turn creating an electric field in the plasma which closes completely upon itself, i.e., a solenoidal electric field. Current flows as a result of this electric field, thus producing a toroidal arc discharge in the arc tube.

High-intensity, metal halide discharge lamps, such as the aforementioned electrodeless lamps, generally provide good color rendition and high efficacy in accordance with the principles of general purpose illumination. However, the lifetime of such lamps can be limited by the loss of the metallic portion of the metal halide fill during lamp operation and the corresponding buildup of free halogen. In particular, the loss of the metal atoms shortens the useful life of the lamp by reducing the visible light output. Moreover, the loss of the metal atoms leads to the release of free halogen into the arc tube, which may cause arc instability and eventual arc extinction, especially in electrodeless high-intensity, metal halide discharge lamps.

The loss of the metallic portion of the metal halide fill may be attributable to the electric field of the arc discharge which moves metal ions to the arc tube wall. For example, as explained in Electric Discharge Lamps by John F. Waymouth, M.I.T. Press, 1971, pp. 266–277, in a high-intensity discharge lamp containing a sodium iodide fill, sodium iodide is dissociated by the arc discharge into positive sodium ions and negative iodine ions. The positive sodium ions are driven towards the arc tube wall by the electric field of the arc discharge. Sodium ions which do not recombine with iodine ions before reaching the wall may react chemically at the wall, or they may pass through the wall and then react outside the arc tube. (Normally, there is an outer light-transmissive envelope disposed about the arc tube.) These sodium ions may react to form sodium silicate or sodium oxide by reacting with a silica arc tube or with oxygen impurities. As more and more sodium atoms are lost, light output decreases, and there is also a buildup of free iodine within the arc tube that may lead to arc instability and eventual arc extinction. Furthermore, the arc tube surface may degrade as a result of the ion bombardment. Therefore, it is desirable to prevent the loss of the metallic portion of the metal halide lamp fill and the attendant buildup of free halogen, thereby extending the useful life of the lamp.

OBJECTS OF THE INVENTION

Accordingly, an object of the present invention is to provide means for preventing a substantial loss of the metallic portion of the metal halide fill of a high-intensity, metal halide discharge lamp and hence a substantial buildup of free halogen, thereby extending the useful life of the lamp.

Another object of the present invention is to provide a protective coating for the arc tube of a high-intensity, metal halide discharge lamp for preventing a substantial loss of the metallic portion of the metal halide fill of a high-intensity, metal halide discharge lamp and hence a substantial buildup of free halogen.

Still another object of the present invention is to provide a method for applying a protective coating to the arc tube of a high-intensity, metal halide discharge lamp in order to prevent a substantial loss of the metallic portion of the metal halide fill of a high-intensity, metal halide discharge lamp and hence a substantial buildup of free halogen.

SUMMARY OF THE INVENTION

The foregoing and other objects of the present invention are achieved in a new and improved protective coating for the arc tube of a high intensity, metal halide discharge lamp. The protective coating of the present invention comprises a layer of beryllium oxide applied to the inner surface of the arc tube. In particular, the beryllium oxide coating is of suitable thickness to prevent a substantial loss of the metallic portion of the metal halide fill and hence a substantial buildup of free halogen, thereby extending the useful life of the lamp. Furthermore, the beryllium oxide coating is sufficiently thin so as to allow only minimal blockage of visible light output from the arc tube.

A preferred method for applying the protective beryllium oxide coating to the arc tube involves evaporating beryllium on the inner surface of the arc tube and then forming the beryllium oxide coating by heating the arc tube in an oxidizing atmosphere.

BRIEF DESCRIPTION OF THE DRAWING

The features and advantages of the present invention will become apparent from the following detailed description of the invention when read with the sole accompanying drawing FIGURE which illustrates a high-intensity, metal halide discharge lamp employing the protective coating of the present invention.

DETAILED DESCRIPTION OF THE INVENTION

Figure 1:
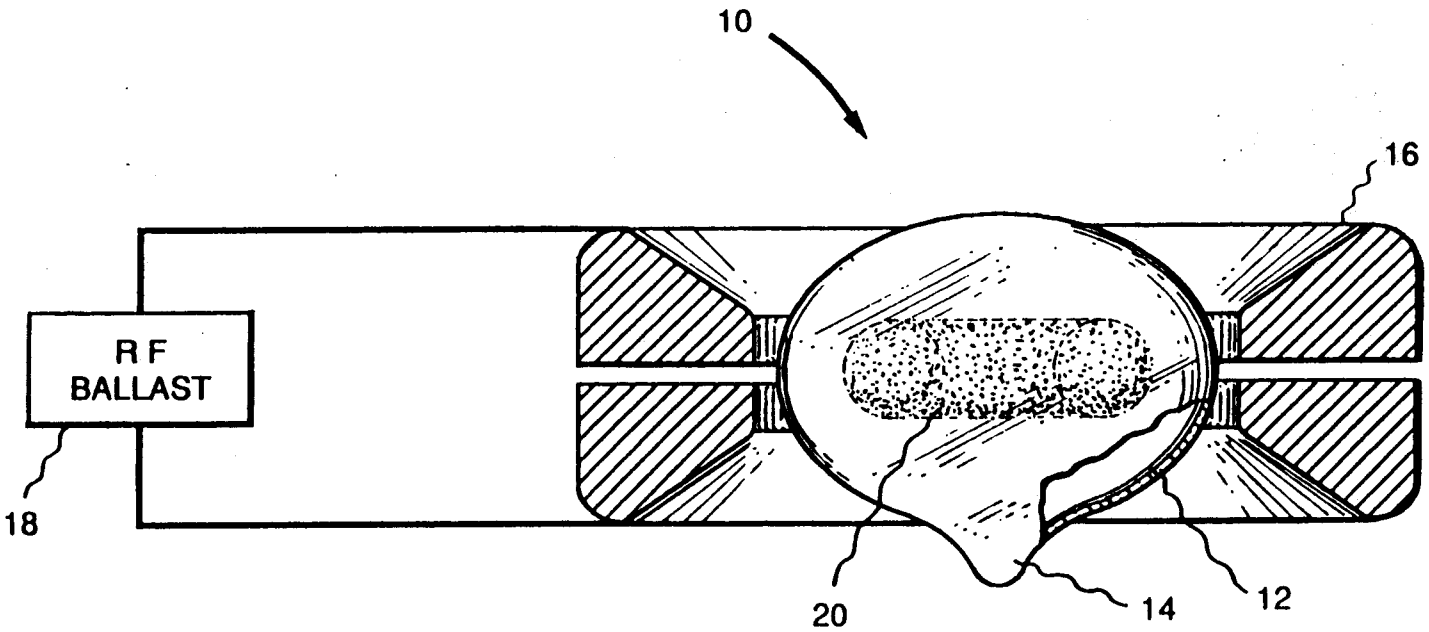

The sole drawing FIGURE illustrates a high-intensity, metal halide discharge lamp 10 employing a protective coating 12 in accordance with the present invention. For purposes of illustration, lamp 10 is shown as an electrodeless, high-intensity, metal halide discharge lamp. However, it is to be understood that the principles of the present invention apply equally well to high-intensity, metal halide discharge lamps having electrodes. As shown, electrodeless metal halide discharge lamp 10 includes an arc tube 14 formed of a high temperature glass, such as fused silica, or an optically transparent ceramic, such as polycrystalline alumina. By way of example, arc tube 14 is shown as having a substantially ellipsoid shape. However, arc tubes of other shapes may be desirable, depending upon the application. For example, arc tube 14 may be spherical or may have the shape of a short cylinder, or "pillbox", having rounded edges, if desired.

Arc tube 14 contains a metal halide fill in which a solenoidal arc discharge is excited during lamp operation. A suitable fill, described in commonly assigned P. D. Johnson, J. T. Dakin and J. M. Anderson U.S. Pat. No. 4,810,938 , issued on Mar. 7, 1989, comprises a sodium halide, a cerium halide and xenon combined in weight proportions to generate visible radiation exhibiting high efficacy and good color rendering capability at white color temperatures. For example, such a fill according to the Johnson et al. patent may comprise sodium iodide and cerium chloride, in equal weight proportions, in combination with xenon at a partial pressure of about 500 torr. The Johnson et al. patent is hereby incorporated by reference. Another suitable fill is described in copending H. L. Witting U.S. patent application Ser. No. 348,433, filed May 8, 1989, now U.S. Pat. No. 4,972,120, and assigned to the instant assignee, which patent application is hereby incorporated by reference. The fill of the Witting application comprises a combination of a lanthanum halide, a sodium halide, a cerium halide and xenon or krypton as a buffer gas. For example, a fill according to the Witting application may comprise a combination of lanthanum iodide, sodium iodide, cerium iodide, and 250 torr partial pressure of xenon.

Electrical power is applied to the HID lamp by an excitation coil 16 disposed about arc tube 14 which is driven by an RF signal via a ballast 18. A suitable excitation coil 16 may comprise, for example, a two-turn coil having a configuration such as that described in commonly assigned, copending G. A. Farrall U.S. patent application Ser. No. 493,266, filed Mar. 14, 1990, which patent application is hereby incorporated by reference. Such a coil configuration results in very high efficiency and causes only minimal blockage of light from the lamp. The overall shape of the excitation coil of the Farrall application is generally that of a surface formed by rotating a bilaterally symmetrical trapezoid about a coil center line situated in the same plane as the trapezoid, but which line does not intersect the trapezoid. However, other suitable coil configurations may be used, such as that described in commonly assigned J. M. Anderson U.S. Pat. No. 4,812,702, issued Mar. 14, 1989, which patent is hereby incorporated by reference. In particular, the Anderson patent describes a coil having six turns which are arranged to have a substantially V-shaped cross section on each side of a coil center line. Still another suitable excitation coil may be of solenoidal shape, for example.

In operation, RF current in coil 16 results in a time-varying magnetic field which produces within arc tube 14 an electric field that completely closes upon itself. Current flows through the fill within arc tube 14 as a result of this solenoidal electric field, producing a toroidal arc discharge 20 in arc tube 14. The operation of an exemplary electrodeless HID lamp is described in Johnson et al. U.S. Pat. No. 4,810,938, cited hereinabove.

In accordance with the present invention, the protective coating 12 applied to the inner surface of arc tube 14 is of sufficient thickness to prevent a substantial loss of the metallic portion of the metal halide fill and hence a corresponding substantial buildup of free halogen. In addition, the protective coating must be sufficiently thin to allow only minimal blockage of visible light output from the arc tube. Advantageously, since the metallic portion of the fill generates the visible radiation during lamp operation, the useful life of the lamp is extended by preventing a substantial loss thereof. Furthermore, since a buildup of free halogen typically causes arc instability and eventual arc extinction, preventing such a buildup likewise extends the useful life of the lamp.

In a preferred embodiment of the present invention, arc tube 14 is comprised of fused silica, and protective coating 12 comprises a layer of beryllium oxide. A preferred thickness of beryllium oxide coating 12 is between 5 and 500 nanometers, with a more preferred range being from 50 to 200 nanometers. Beryllium oxide is a preferred protective coating because it has a relatively low thermal expansion coefficient and a high melting point. In addition, beryllium oxide may be advantageously employed as a coating on fused silica arc tubes because the chemical stability of beryllium oxide as characterized by the free energy of formation is comparable with silica.

In another aspect of the present invention, a method for applying protective coating 12 to arc tube 14 is provided. In general, a preferred method involves evaporating beryllium on the inner surface of the arc tube under non-oxidizing conditions, and then forming beryllium oxide by heating the arc tube in an oxidizing atmosphere. The following example illustrates the method of the present invention as applied to an electrodeless, high-intensity, metal halide discharge lamp.

EXAMPLE

A protective beryllium oxide coating was applied to the inner surface of a fused silica arc tube (20 mm outer diameter and 13 mm height) of an electrodeless, high-intensity discharge lamp by first inserting approximately 100 micrograms of beryllium into the arc tube through an attached exhaust tube. The beryllium was maintained in the center of the arc tube and heated to approximately 1200° C. in a less than $10^{-5}$ torr vacuum. After heating, an approximately 100 nm thick layer of beryllium was deposited on the inner surface of the arc tube. The arc tube was then moved to a furnace and heated in air at approximately 900° C. to form an approximately 170 nm thick layer of beryllium oxide.

The lamp was operated on a life test using a 250 Watt, RF power supply at 13.56 MHz which delivered current to a two-turn excitation coil surrounding the arc tube. The lamps were periodically removed from the life test to measure the light output and the level of free iodine. The level of free iodine was monitored by measuring the optical absorption at a wavelength of 520 nm.

After 900 hours, the iodine level was measured to be less than 0.03 mg. This level was compared with that of an arc tube previously made and operated in the same way which exhibited a free iodine level of more than 0.2 mg at 900 hours. Moreover, while the arc tube that was not coated with beryllium oxide exhibited increasing levels of free iodine that led to arc instability and eventual arc extinction, the coated arc tube did not exhibit increasing levels of free iodine, but maintained substantially the same level throughout the life test.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

What is claimed is:

1. A high intensity discharge lamp, comprising:

a light-transmissive arc tube for containing a plasma arc discharge;

a fill disposed in said arc tube, said fill including at least one metal halide;

excitation means for coupling electrical power to said fill for exciting said arc discharge therein; and a protective beryllium oxide coating disposed on the inner surface of said arc tube of sufficient thickness to prevent a substantial loss of the metallic portion of said fill and a corresponding substantial buildup of free halogen in said arc tube.

2. The lamp of claim 1 wherein said arc tube is comprised of fused silica.

3. The lamp of claim 1 wherein the thickness of said protective beryllium oxide coating is in the range from approximately 5 to 500 nanometers.

4. The lamp of claim 3 wherein the thickness of said protective beryllium oxide coating is in the range from approximately 50 to 200 nanometers.

5. An electrodeless high intensity discharge lamp, comprising:

a light-transmissive arc tube for containing a plasma arc discharge;

a fill disposed in said arc tube, said fill including at least one metal halide;

an excitation coil disposed about said arc tube and adapted to be coupled to a radio frequency power supply for exciting said arc discharge in said fill; and a protective beryllium oxide coating disposed on the inner surface of said arc tube of sufficient thickness to prevent a substantial loss of the metallic portion of said fill and a corresponding substantial buildup of free halogen in said arc tube.

6. The lamp of claim 5 wherein said arc tube is comprised of fused silica.

7. The lamp of claim 5 wherein the thickness of said protective beryllium oxide coating is in the range from approximately 5 to 500 nanometers.

8. The lamp of claim 7 wherein the thickness of said protective beryllium oxide coating is in the range from approximately 50 to 200 nanometers.

9. A method for manufacturing an electrodeless, high-intensity, metal halide discharge lamp having an arc tube for containing a plasma arc discharge, comprising the steps of:

applying a beryllium oxide coating to the inner surface of said arc tube;

filling said arc tube with a fill including at least one metal halide;

adding a buffer gas to said fill; and sealing said arc tube.

10. The method of claim 9 wherein said step of applying said beryllium oxide coating comprises:

filling said arc tube with a predetermined quantity of beryllium;

evaporating said beryllium under non-oxidizing conditions to form a layer thereof on the inner surface of said arc tube; and heating said beryllium in an oxidizing atmosphere to form said beryllium oxide coating.

* * * * *